US006250972B1

(12) United States Patent
Shinchi et al.

(10) Patent No.: US 6,250,972 B1
(45) Date of Patent: Jun. 26, 2001

(54) CONNECTOR HAVING WATERPROOF STRUCTURE

(75) Inventors: Akira Shinchi; Norihiro Ohashi, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/359,881

(22) Filed: Jul. 26, 1999

(30) Foreign Application Priority Data

Jul. 27, 1998 (JP) ..... 10-211472

(51) Int. Cl.[7] ..... H01R 13/514
(52) U.S. Cl. ..... 439/752; 439/465
(58) Field of Search ..... 439/733.1, 587, 439/752, 465, 467, 459

(56) References Cited

U.S. PATENT DOCUMENTS 5,435,758 * 7/1995 Sassai et al. ..... 439/752
5,569,050 * 10/1996 Lloyd ..... 439/465
5,609,503 * 3/1997 Tsuji et al. ..... 439/752
5,836,788 11/1998 Torii .
5,928,033 * 7/1999 Kato et al. ..... 439/587
5,957,732 * 9/1999 Ito et al. ..... 439/752

FOREIGN PATENT DOCUMENTS 9-320651 12/1997 (JP) .

* cited by examiner

*Primary Examiner*—Neil Abrams
*Assistant Examiner*—Phuong K T Dinh
(74) *Attorney, Agent, or Firm*—Finnegan, Henderson, Farabow, Garrett & Dunner, L.L.P.

(57) ABSTRACT

A waterproof connector is provided. The connector includes a housing 12 having terminal accommodating chambers 15 for accommodating terminals 14 and a cover 13 overlaid on the housing 12 to define wire insertion holes 20 between the cover 13 and the housing 12. The cover 13 is provided with a fall-stop engagement part 31 which engages with respective rear ends of the terminals 14 in order to prevent them from falling out of housing 12. In order to provide the connector with a waterproof structure, a resinous cover part 3 of each covered wire 1 is welded to both housing 12 and cover 13 by ultrasonic oscillating the housing 12 under pressure while each wire 1 is inserted into the wire insertion hole 20. Further, owing to the ultrasonic oscillation, the housing 12 is also welded to the cover 13 in the resultant waterproof structure.

6 Claims, 5 Drawing Sheets

CONNECTOR HAVING WATERPROOF STRUCTURE

BACKGROUND OF THE INVENTION

1. Field of the Invention

The present invention relates to a waterproof connector having a wire insertion part characterized by a waterproof structure resulting from ultrasonic oscillation.

2. Description of the Related Art

Japanese Unexamined Patent Publication (kokai) No. 9-320651 discloses one conventional waterproof structure for the connector. In the publication, there are shown covered wires each having a conductor covered with a synthetic covering part. In this structure, a pair of upper and lower resinous tips are used for a part of the structure where two covered wires intersect with each other.

The lower resinous tip is provided, at a center portion thereof, with a projecting welding boss and also provided, at the four corners, with guide grooves into which the covered wires are accommodated. Each guide groove has a cover removing part and a waterproof groove part, which are formed along a direction extending from the welding boss toward the outside, in order There is remained a gap defined between each guide groove and the welding boss.

Similarly to the lower resinous tip, the upper resinous tip has a welding boss formed to project at the center portion and four guide grooves formed on four corners to define gaps between each guide groove and the welding boss. Also in each guide groove, a cover removing part and a waterproof groove part are formed in order.

According to the above-mentioned structure, on condition of setting the lower resinous tip in an amble, the covered wires are inserted into the guide grooves of the lower resinous tip so as to intersect with each other and sequentially, the upper resinous tip is turned over and abutted on the lower resinous tip. This abutment allows both welding bosses of the upper and lower tips to mutually contact with each other and also causes the covered wires to be interposed between the guide grooves. In this state, the resultant assembly is subjected to the ultrasonic oscillation by an ultrasonic horn exerting pressure on the upper tip.

Consequently, the cover parts of the covered wires are molten to enter into the waterproof grooves, so that both conductors are exposed and connected with each other. The further continuation of ultrasonic oscillating under pressure allows both of the welding bosses to be molten and welded to each other. In this state, the waterproof grooves are filled up with the molten resinous material forming the insulating cover parts. Thereafter, as time goes by, the molten material of the cover parts is hardened while fulfilling the waterproof grooves in the form of a ring, whereby the connection having the waterproof characteristic can be provided between the intersecting covered wires.

Because of its effectiveness in the covered wires, the availability of the above-mentioned waterproof structure to a connector which accommodates terminals connected to the wires would make it to be a waterproof connector. In this case, it is executed to engage each terminal doubly in order to prevent it from withdrawing from the connector certainly.

The availability to the connector is carried out in accordance with the following steps of:

① inserting each covered wire into each terminal and connecting the former with the latter by the terminal's crimping etc.;

② accommodating the terminal having the covered wire connected thereto in a housing of the connector and engaging the terminal with an engagement lance;

③ sequentially subjecting the covered wire extending from the rear end of each terminal to the ultrasonic oscillation under pressure thereby to melt the insulating cover part of the covered wire for the resultant waterproof structure; and ④ engaging the terminal with double engagement members for fall-stop after the step of ③.

On the contrary, the double engagement operation of the terminal, which has been adopted up to now, comprises the steps of:

① connecting each covered wire to each terminal;

② accommodating the terminal in the housing and engaging it therein; and

③ engaging the terminal in the housing doubly.

That is, the former operation for the above-mentioned waterproof structure has a large number of steps in comparison with the number of steps in the latter operation, by the waterproofing. Furthermore, the former operation requires the double engagement members for the double engagement, increasing the number of components.

SUMMARY OF THE INVENTION

Under such a circumstance, it is therefore an object of the present invention to provide a waterproof connector in which respective insulating cover parts of covered wires are molten for its waterproof structure and which is capable of engaging terminals being connected to the wires in the housing doubly without increasing the numbers of manufacturing steps and components.

The object of the present invention described above can be accomplished by a waterproof connector for a plurality of covered wires having conductors covered with cover parts of resinous material, the waterproof connector comprising:

a housing having a plurality of terminal accommodating chambers formed for respectively accommodating a plurality of terminals therein, the terminals being connected with respective leading ends of the covered wires; and a cover to be overlaid on the housing thereby to define a plurality of wire insertion holes for the covered wires between the cover and the housing;

wherein the cover is provided with a fall-stop engagement part which engages with respective rear ends of the terminals in order to prevent the terminals from falling out of the housing; and wherein a waterproof structure where the cover parts of the covered wires are welded to both of the housing and the cover being also welded to the housing, is provided by ultrasonic oscillating the housing under pressure while the covered wires are inserted into the wire insertion holes, respectively.

According to the above-mentioned structure, it is carried out to insert the covered wires into the wire insertion holes when putting the cover on the housing. Under such a situation, the ultrasonic oscillating and pressing on the connector allows the cover parts of the wires to be molten and welded to both of the housing and the cover, whereby the waterproof capacity is provided for the connector by the molten cover parts of the wires. Further, the covering of the housing with the cover allows the fall-stop engagement part of the cover to engage with the rear parts of the terminals in the terminal accommodating chambers doubly. Additionally, since the housing is also welded to the cover by the ultrasonic oscillation, the cover can be assembled to the housing stably, so that it is possible to eliminate the possibility of the fall-stop engagement part being disengaged from the terminals.

According to the invention, since the double engagement of the terminals is accomplished at the same time of putting the cover on the housing, there is no increase in the number of steps of completing the waterproof structure. Furthermore, there is no increase in the number of components since the cover serves a part of the double engagement for the terminals in addition to the engagement in the terminal accommodating chambers.

According to the second aspect of the invention, each of the terminals is provided with an engagement projection having a rear portion with which the fall-stop engagement part of the cover is to be engaged. In this case, since the fall-stop engagement part of the cover engages with the engagement projections of the terminals, it is possible to carry out the double engagement for the terminals in addition to the engagement in the terminal accommodating chambers, more certainly.

According to the third aspect of the invention, the waterproof connector further comprises a press bending part which presses the covered wires to bend them in a direction to intersect with the axial directions of the covered wires when the housing is covered with the cover.

In this case, the press bending part operates as a strain-relief element for the covered wire. Thus, even if any axial stress is applied on the wire, the stress is not transmitted to the terminal owing to the strain-relief action by the press bending part. Thus, the wires can be prevented from being withdrawn from the connector.

According to the fourth aspect of the invention, more preferably to the waterproof connector of the third aspect, the press bending part has a plurality of bending grooves which are formed so as to be raised on the housing and a press portion which is formed on the cover so as to press the covered wires into the bending grooves.

In this case, when the press portion on the cover does press the covered wires, then the bending grooves on the housing depress the covered wire for bending, so that it is possible to bend the wires in the direction crossing the axial direction of the wires certainly.

According to the fifth aspect of the invention, each of the terminal accommodating chamber is provided, at an interior thereof, with a projecting lance for engagement with each of the terminals accommodated in the terminal accommodating chambers.

In this case, owing to the provision of the projecting lance, each terminal can be retained in the terminal accommodating chambers securely.

According to the sixth aspect of the invention, the waterproof connector may further include a second cover to be overlaid on the housing thereby to define a plurality of wire insertion holes for the covered wires between the second cover and the housing. Also in this case, preferably, the second cover is provided with another fall-stop engagement part which engages with respective rear ends of the terminals in order to prevent the terminals from falling out of the housing.

These and other objects and features of the present invention will become more fully apparent from the following description and appended claims taken in conjunction with the accompany drawings.

DESCRIPTION OF THE PREFERRED EMBODIMENT

One embodiment of the waterproof structure for the connector will be described with reference to the drawings.

Figure 1:
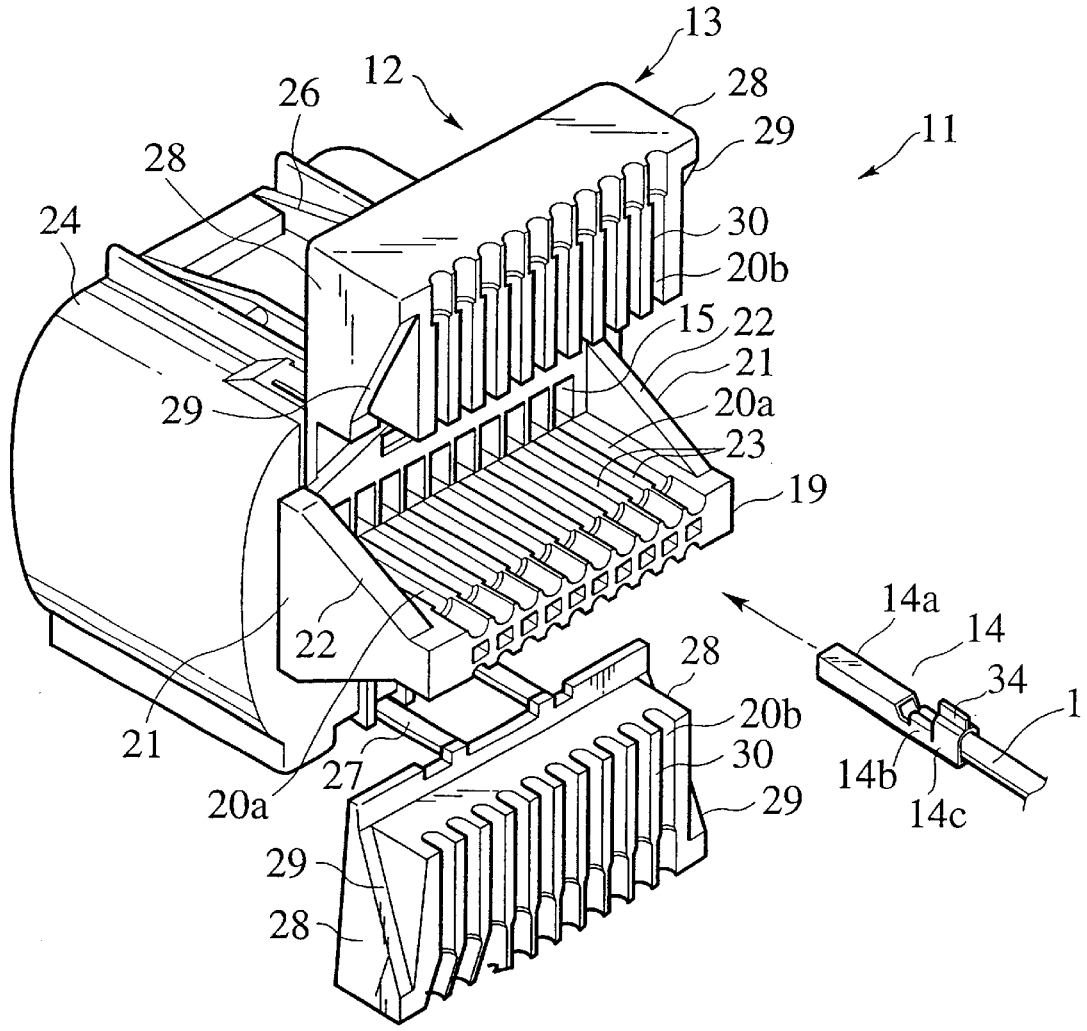
FIG. 1 is an overall perspective view of a waterproof connector in accordance with an embodiment of the present invention.
Figure 2:
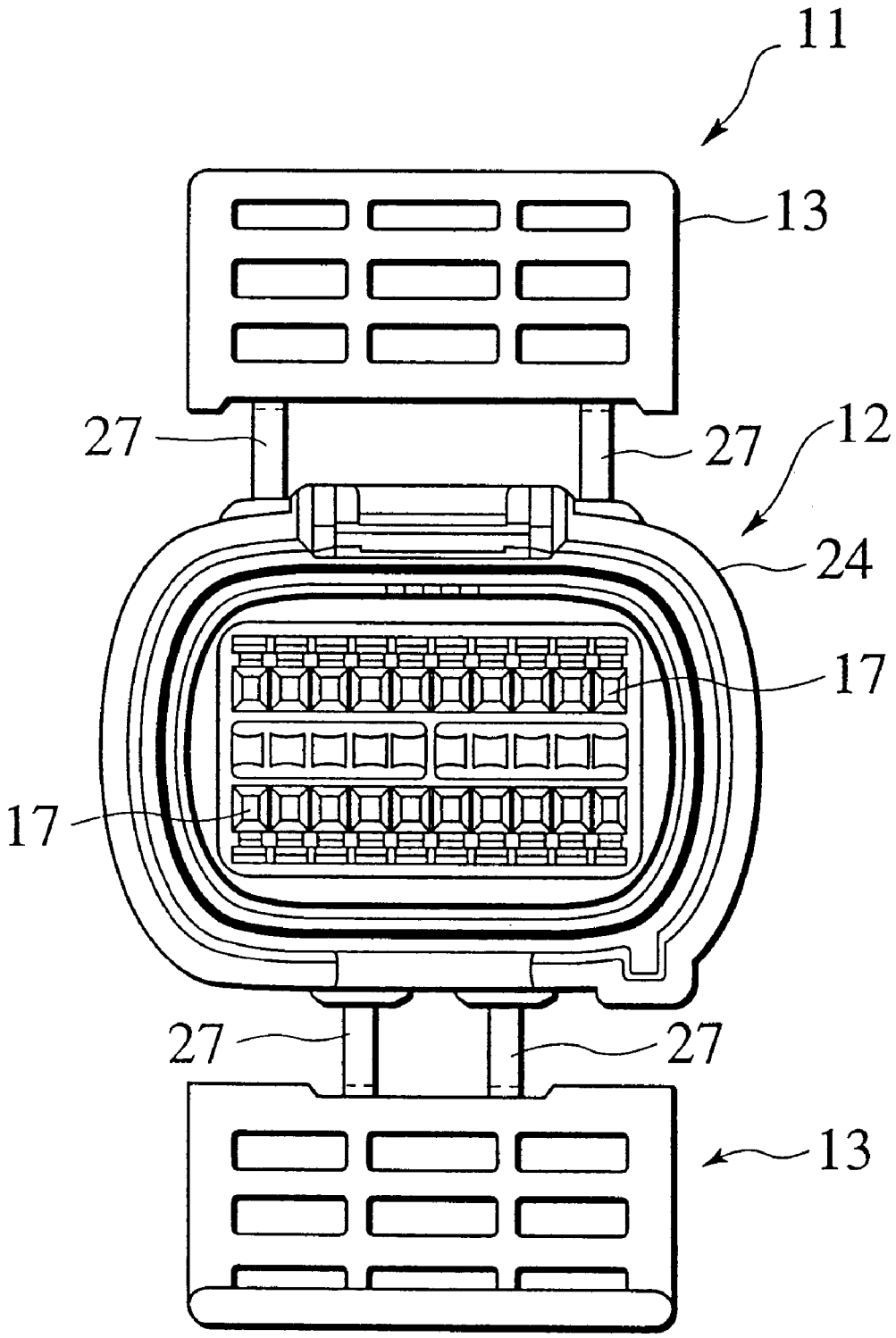
FIG. 2 is a front view of the waterproof connector of the embodiment of the present invention.

As shown in FIGS. 1 and 2, a waterproof connector 11 comprises a housing 12 and covers 13. The housing 12 is provided with a plurality of terminal accommodating chambers 15 for accommodating a plurality of terminals 14 therein, respectively. In the housing 12, the chambers 15 are arranged so as to stand in high and low ranks. Horizontally formed at the intermediate portion of the housing 12 is a support wall 18 (see FIG. 5) which divides the terminal accommodating chambers 15 into high and low groups.

Figure 5:
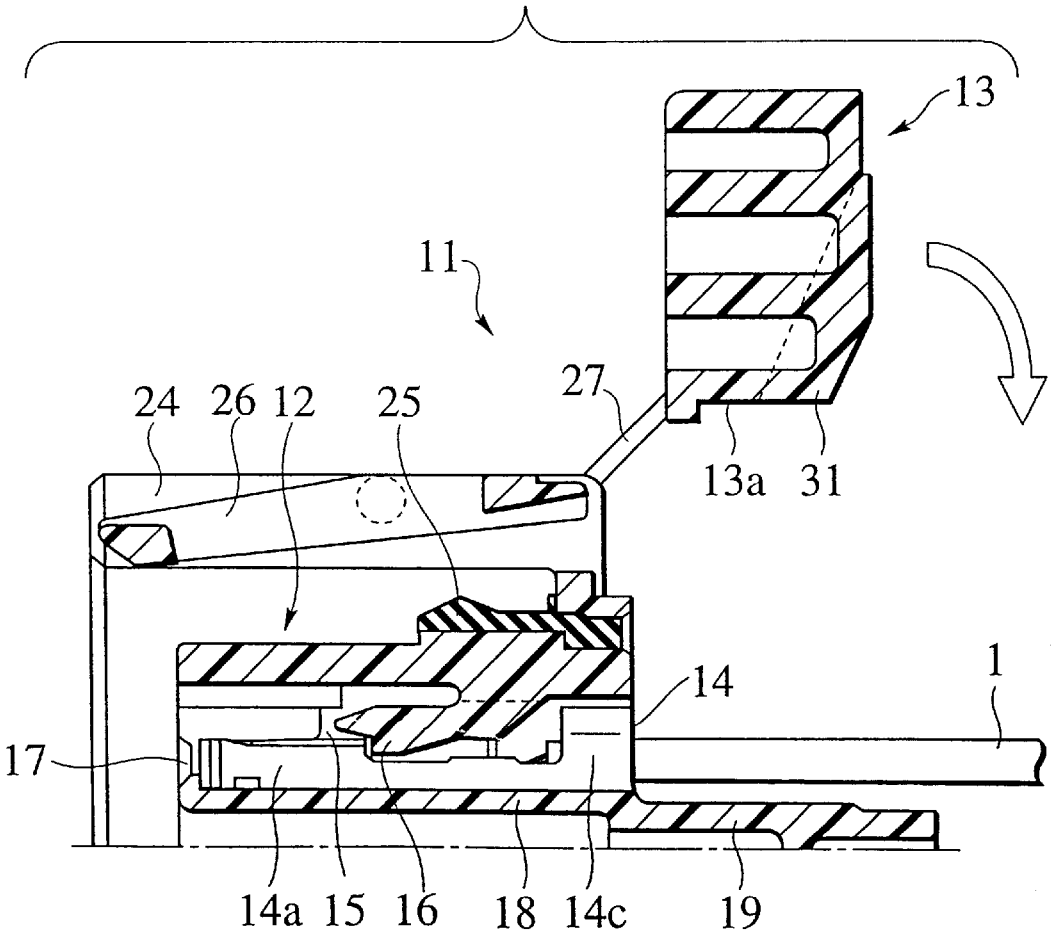
FIG. 5 is a partial cross sectional view showing a condition to accommodate the terminal in a terminal accommodating chamber.
Figure 6:
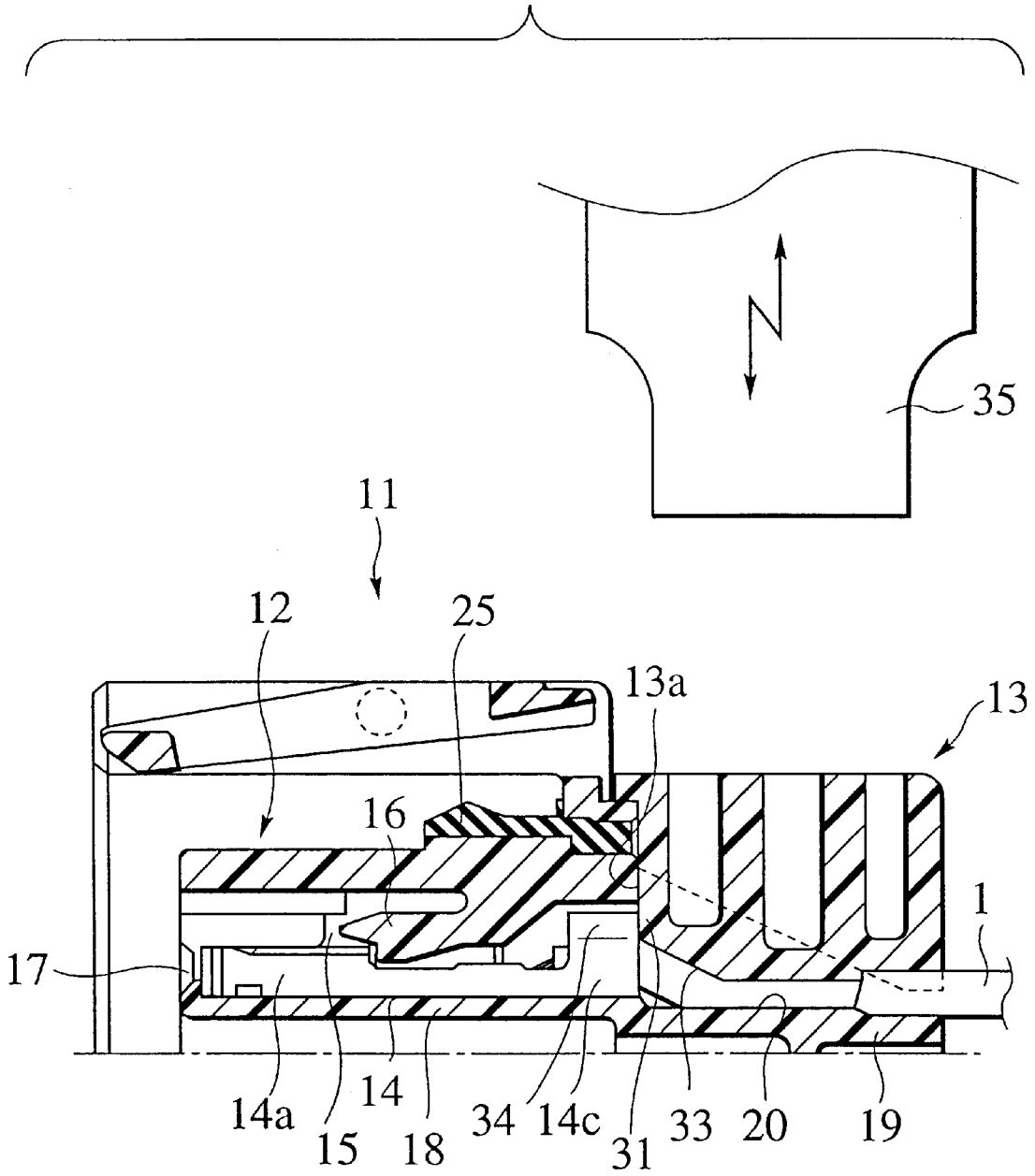
FIG. 6 is a partial cross sectional view showing a condition to carry out the ultrasonic oscillation upon putting a cover on the terminal.

As shown in FIGS. 5 and 6, in each of the terminal accommodating chambers 15, an engaging lance 16 is projecting for engaging with a rear end of a contact part 14*a* of the terminal 14. The contact part 14*a* of the terminal 14 is brought into contact with a not-shown terminal to be mated with the terminal 14. Formed at a leading end of each terminal accommodating chamber 15 is a terminal insertion hole 17 through which the mating terminal is entered into the housing 12. The support wall 18 is formed to extend from the terminal accommodating chamber 15 to the rear side, thereby providing a wire cradle 19 mentioned later.

On the outside of the housing 12, a hood part 24 is provided for enclosing the housing 12. The hood part 24 is constituted by a curved body in the form of a rectangular cylinder and provided with an opened front face through which a mating connector (not shown) is to be inserted and fitted into the hood part 24. In order to fix the mating connector being inserted into the hood part 24, it is equipped with a waterproof packing 25. Additionally, on a top face of the hood part 24, a lock arm 26 is provided for locking the mating connector in its engaged condition. Note, the rear face of the hood part 23 is closed except the terminal accommodating chambers 15 and first wire accommodating grooves 20*a* of the wire cradle 19, which will be described later.

As shown in FIG. 1, the wire cradle 19 is rectangular-shaped in plan view and provided, on upper and lower faces thereof, with the first wire accommodating grooves 20*a* communicating with the terminal accommodating chambers 15 correspondingly. Further, on each of the left and right ends of the wire cradle 19, a generally-triangular sidewall 21 is integrally formed so as to succeed the rear face of the hood part 24 and gradually decrease the width as it approaches the rear end of the cradle 19. Each sidewall 21 has upper and lower end faces providing welding sides 22 which are to be welded to the covers 13 by the ultrasonic oscillation. The wire accommodating grooves 20*a* are defined by the left and right sidewalls 21 and also partition walls 23 which are formed between the sidewalls 21 in parallel with each other.

The covers 13 are provided up and down so as to correspond to the upper and lower faces of the wire cradle 19. The respective covers 13 are rectangular-shaped of the same dimensions as those of the wire cradle 19. The overlapping of the covers 13 on the wire cradle 19 allows the upper and lower faces of the cradle 19 to be closed. In this embodiment, the upper and lower covers 13 are connected with the hood part 24 through hinges 27 on the rear face of the hood part 24. Thus, in the arrangement, the rotation of the hinges 27 causes the wire cradle 19 to be covered with the covers 13. Alternatively, the covers 13 do not have to be connected with the hood part 24 through the hinges 27 and may be constituted by separable members from the hood part 24 in the modification.

Each cover 13 is provided, corresponding to the sidewalls 21 of the cradle 19, with left and right sidewalls 28 having respective tapered faces 29 and partition walls 30 formed between the sidewalls 28 in parallel with each other. Thus, respective gap portions separated by the respective partition walls 30 and also the sidewalls 28 do constitute second wire accommodating grooves 20*b*. When the wire cradle 19 is covered with the covers 13, the second wire accommodating grooves 20*b* accord with the wire accommodating grooves 20*a* on the cradle's side, respectively. Thus, the respective accordance of the wire accommodating grooves 20*a* with the grooves 20*b* allows wire insertion holes 20 for passing the covered wires 1 to be defined in the connector body 11. Again, the above-mentioned tapered faces 29 are adapted so as to abut against the welding sides 22 of the cradle 19, constituting the welding sides 29 being welded to the sides 22 by the ultrasonic oscillation.

Each of the covers 13 is provided with a fall-stop engagement part 31. Engaging with respective rear ends of the terminals 14 accommodated in the terminal accommodating chambers 15, the part 31 serves to prevent the terminals 14 from falling out of the housing 12.

According to the embodiment, as shown in FIG. 6, the fall-stop engagement part 31 is provided by extending an abutment face 13*a* of the cover 13, which contacts with the back face of the hood part 24, in the direction of the terminal accommodating chambers 15 so that the face 13*a* projects to the planes of the terminal accommodating chambers 15. That is, since there is no need to constitute the fall-stop engagement part by another member different from the cover 13, the structure of the connector is simplified. Note, the fall-stop engagement part 31 may be also called as "draft-proof engagement part".

Figure 4:
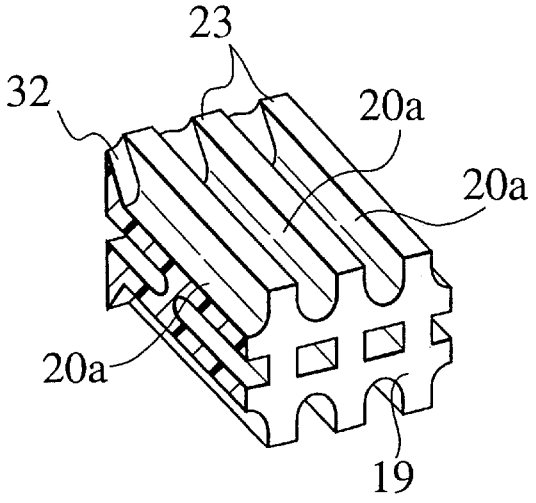
FIG. 4 is a partial perspective view showing bent grooves formed in a housing.

In addition, the housing 12 and the cover 13 are respectively provided with a press bending part (press bender) which consists of a plurality of bending grooves 32 and a press portion 33 for bending the covered wires 1. As shown in FIG. 4, the bending grooves 32 are provided by raising the bottom faces of the wire accommodating grooves 20*a* of the wire cradle 19 obliquely, on one hand. On the other hand, the press portion 33 is provided by forming a tapered face on the wire accommodating grooves 20*b* of the cover 13, in the vicinity of the abutment face 13*a*. When putting the cover 13 on the wire cradle 19, the press portion 33 acts to force the covered wires 1 accommodated in the wire accommodating grooves 20*a* of the wire cradle 19 against the bending grooves 32 for depression.

As shown in FIG. 1, the terminal 14 includes a crimping part 14*c* crimped for connection with the covered wire 1, a connecting part 14*b* crimped against the conductor 2 exposed from the covered wire 1 for electrical connection with the conductor 2 and a contact part 14*a* in electrical contact with the mating terminal. At the crimping part 14*c* of the terminal 14, an engagement projection 34 is formed so as to project from the part 14*c* outward. Engaged with the engagement projection 34 from its rear side is the fall-stop engagement part 31 of the cover 13, which is described above. Owing to this engagement in addition to the engagement lance 16, the terminal 14 can be engaged in the housing 12 doubly.

Each of the covered wire 1 consists of the conductor 2 and the cover part 3 for covering the periphery of the conductor 2. The cover part 3 is made of resinous material. Preferably, vinyl chloride resin is employed for the material of the cover part 3. Including the housing 12 and the covers 13, the whole waterproof connector 1 may be made of acrylic resin, ABS (acrylonitrile-butadiene-styrene) resin, PC (poly-carbonate) resin, polyolefin resin (e.g. polyethylene), PEI (polyether imido) resin, PBT (polybutylene terephthalate) resin, or the like. These resinous materials are characterized in their hardness in comparison with the resin constituting the cover part 3.

Next, we describe the assembling method of the connector of the embodiment with reference to FIGS. 5 and 6. On condition of opening the cover 13 as shown in FIG. 5, the terminals 14 connected with the covered wires 1 are accommodated in the terminal accommodating chambers 15 in the housing 12. With this accommodation, each lance 16 in the terminal accommodating chamber 15 is engaged with the contact part 14*a* of the terminal 14. Note, during this accommodation, the covered wires 1 are lowered into the wire accommodating grooves 20*a* on the wire cradle 19, respectively.

Next, by pivoting the hinges 27, the covers 13 are overlaid on the upper and lower faces of the wire cradle 19. With the rotation of the covers 13, the welding sides 22 of the wire cradle 19 are brought into close contact with the welding sides 29 of the covers 13 and furthermore, the wire insertion holes 20 as passages for the wires 1 are defined by the wire accommodating grooves 20*a* on the wire cradle 19 and the wire accommodating grooves 20*b* abutting on the grooves 20*a*.

As shown in FIG. 6, when the press portion 33 of the cover 13 presses the covered wires 1 into the bending grooves 32, then the depression allows each wire 1 to bend in a direction to intersect with the axial direction of the wire 1. Further, the fall-stop engagement part 31 formed on the abutment face 13*a* of each cover 13 engages with the crimping part 14*a* of each terminal 14 from its rear side.

Figure 3:
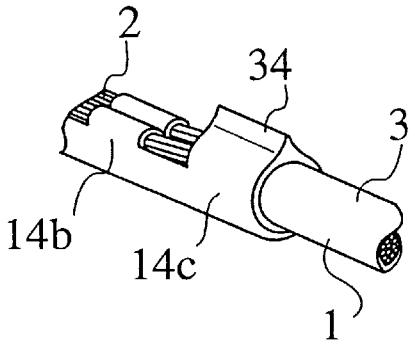
FIG. 3 is a perspective view showing a terminal.

Next, it is executed to put the lower cover 13 on an anvil (not shown) and abut the upper cover 13 on a horn 40. In this way, while interposing the assembly between the anvil and the horn 40 under pressure, the ultrasonic oscillation (vertical vibrations) is applied on the connector body 11 by the horn 40 (see FIG. 3). By the vertical vibration due to the ultrasonic oscillation, the cover parts 3 in contact with the wire cradle 19 and the covers 13 are firstly molten and thereafter, the cradle 19 and the covers 13 in contact with the covered wires 1 are partially molten.

Since the molten materials in this way are mutually mixed with each other and hardened, there can be formed a resinous binding layer being welded to the covered wires 1, on the boundary between the wire insertion holes 20 and the covered wires 1. Thus, the so-formed layer serves to prevent the water from entering between the wire insertion holes 20 and the covered wires 1, so that the advantageous waterproof structure can be provided.

This ultrasonic oscillation is somewhat maintained even after the above waterproof structure has been obtained. Consequently, the welding sides 22 of the wire cradle 19 and the welding sides 29 of the covers 13 are molten and welded to each other. In this way, the wire cradle 19 and the covers 13 are combined into one body. As the cover 13 is stably fixed on the wire cradle 19 owing to the above integration, the covered wires 1 is maintained in the bending condition certainly. Further, it is possible to avoid the fall-stop engagement part 31 from being disengaged from the terminal 14.

Figure 7:
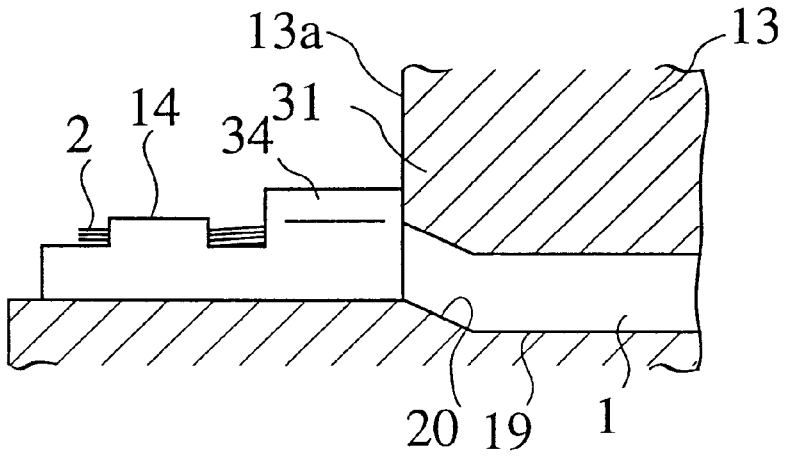
FIG. 7 is a cross sectional view for explanation of the function of a fall-stop (draft-proof) engagement part of the cover.

In the above-mentioned embodiment, when covering the wire cradle 19 of the housing 12 with the cover 13, the fall-step engagement part 31 engages with the rear portions of the terminals 14 in the terminal accommodating chambers 15, as shown in FIG. 7. In this way, the double engagement in addition to the engagement by the lances 16 is effected.

Therefore, since the double engagement of the terminals 14 is accomplished at the same time of putting the cover 13 on the wire cradle 19, there is no increase in numbers of both steps of completing the waterproof structure and components for double engagement, in comparison with the conventional structure.

Figure 8:
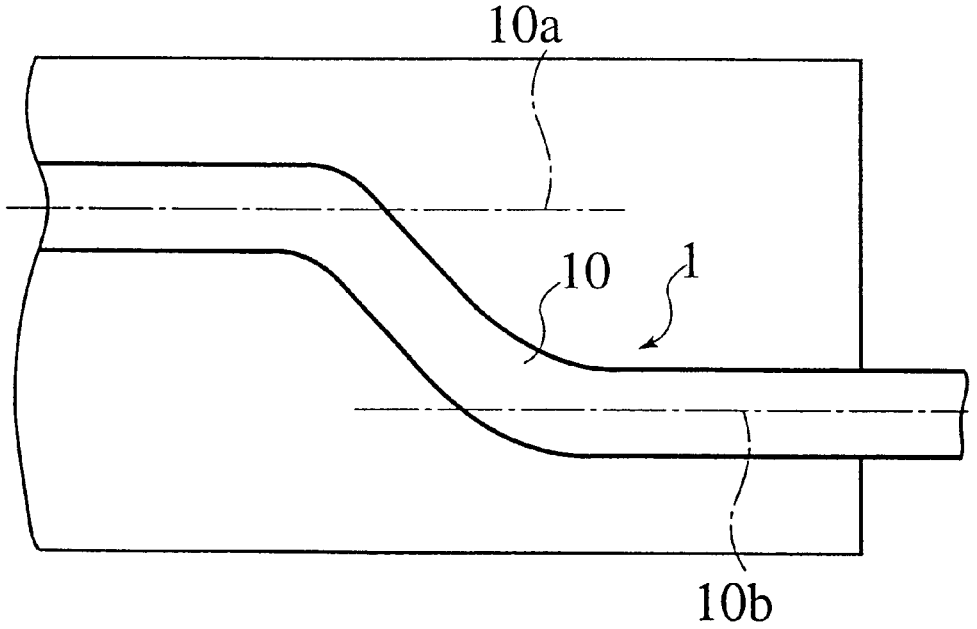
FIG. 8 is a side view for explanation of the function of a press bending part.

FIG. 8 shows a part of the wire 1 being bent by covering the wire cradle 19 with the cover 13. In the figure, reference numeral 10 denotes a bending part of the wire 1. The bending part 10 extend in a direction to cross the axial direction of the wire 1. The covered wire 1 has two-stage axial lines 10*a,* 10*b* on both sides of the bending part 10 as the boundary therebetween.

Accordingly, the bending part 10 operates as a strain-relief element for the covered wire 1. Thus, even if any axial stress is applied on the wire 1 along the axial line 10*b* of the connector, the stress is not transmitted to the wire portion extending along the axial line 10*a*. Therefore, without the wires withdrawal from the terminal 14, the covered wires 1 can be retained in the waterproof structure 11 certainly.

Furthermore, since each terminal 14 of the embodiment is provided with the engagement projection 34 for engagement with the fall-stop engagement part 31 of the cover 13, it is possible to carry out the double engagement for the terminals 14 certainly.

Note, in case that the cover 13 can engage with the terminals 14 certainly, there is no need to provide the terminals 14 with the engagement projections 34. Further, each terminal accommodating chamber 15 may be constructed in a single-step manner.

Finally, it will be understood by those skilled in the art that the foregoing description is related to one preferred embodiment of the disclosed waterproof connector and that various changes and modifications may be made to the present invention without departing from the spirit and scope thereof.

What is claimed is:

1. A waterproof connector for a plurality of covered wires having conductors covered with cover parts of resinous material, the waterproof connector comprising:

a housing having a plurality of terminal accommodating chambers formed for respectively accommodating a plurality of terminals therein, the terminals being connected with respective leading ends of the covered wires; and a cover to be overlaid on the housing thereby to define a plurality of wire insertion holes for the covered wires between the cover and the housing;

wherein the cover is provided with a fall-stop engagement part which engages with respective rear ends of the terminals in order to prevent the terminals from falling out of the housing; and wherein a waterproof structure where the cover parts of the covered wires are welded to both of the housing and the cover being also welded to the housing, is provided by ultrasonic oscillating the housing under pressure while the covered wires are inserted into the wire insertion holes, respectively.

2. A waterproof connector as claimed in claim 1, wherein each of the terminals is provided with an engagement projection having a rear portion with which the fall-stop engagement part of the cover is to be engaged.

3. A waterproof connector as claimed in claim 1, further comprising a press bending part which presses the covered wires to bend them in a direction to intersect with the axial directions of the covered wires when the housing is covered with the cover.

4. A waterproof connector as claimed in claim 3, wherein the press bending part has a plurality of bending grooves which are formed so as to be raised on the housing and a press portion which is formed on the cover so as to press the covered wires into the bending grooves.

5. A waterproof connector as claimed in claim 1, wherein each of the terminal accommodating chamber is provided, at an interior thereof, with a projecting lance for engagement with each of the terminals accommodated in the terminal accommodating chambers.

6. A waterproof connector as claimed in claim 1, further comprising a second cover to be overlaid on the housing thereby to define a plurality of wire insertion holes for the covered wires between the second cover and the housing, wherein the second cover is also provided with another fall-stop engagement part which engages with respective rear ends of the terminals in order to prevent the terminals from falling out of the housing.

* * * * *